US005105738A

United States Patent [19]

Mehaffey

[11] Patent Number: 5,105,738

[45] Date of Patent: Apr. 21, 1992

[54] ARTICULATED HAND STAMP

[75] Inventor: David E. Mehaffey, Charlotte, N.C.

[73] Assignee: Porelon, Incorporated, Cookeville, Tenn.

[21] Appl. No.: 572,155

[22] Filed: Aug. 23, 1990

[51] Int. Cl.[5] ..... B41K 1/42

[52] U.S. Cl. ..... 101/333; 101/103; 101/405

[58] Field of Search ..... 101/103, 104, 105, 109, 101/405, 406, 333, 334

[56] References Cited

U.S. PATENT DOCUMENTS

| | | | |
|---|---|---|---|
| 3,760,721 | 9/1973 | Stier | 101/104 |
| 4,432,281 | 2/1984 | Wall et al. | 101/104 |
| 4,530,281 | 7/1985 | Verdeme | 101/104 |
| 4,928,594 | 5/1990 | Bostick | 101/405 |

FOREIGN PATENT DOCUMENTS

| | | | |
|---|---|---|---|
| 944493 | 6/1956 | Fed. Rep. of Germany | 101/405 |

*Primary Examiner*—Edgar S. Burr

*Assistant Examiner*—Joseph R. Keating

*Attorney, Agent, or Firm*—Foley & Lardner

[57] ABSTRACT

An articulating hand stamp mechanism is disclosed which is capable of being articulated between closed and open positions. In the closed position, a pair of pivotally connected split housings enclose the stamp pad and its housing completely. The mechanism may be articulated open by causing the housings to rotate about the pivot point which in turn results in the stamp pad housing to rotate to a horizontal position so that the pad can be brought against an article to be marked. Each of the split housings has had grasping portions with one of the hand grasping portions having a pressure bearing surface canted at an angle with respect to the other portion when the mechanism is closed. Because the pressure surfaces are canted and positioned a distance away from the pivot point, increased torque is provided, allowing the mechanism to be easily opened when desired while simultaneously minimizing opening caused by unintentionally applied force.

14 Claims, 3 Drawing Sheets

ARTICULATED HAND STAMP

BACKGROUND OF THE INVENTION

1. Field of the Invention

This invention relates to hand stamp mechanisms, particularly to hand stamp mechanisms in which the stamp can be articulated between an open position in which the stamp is operative and a closed position in which the stamp is enclosed within the mechanism.

2. Description of the Prior Art

Hand stamps have been fabricated in a multitude of shapes and styles for many years. A particularly useful type is the articulating stamp which can be easily stored when in a closed position since the stamp pad is rotated into a compact relationship with the housing. The compactness facilitates storage since a number of stamp mechanisms can be packaged together in a relatively small volume. Additionally, the enclosure of the stamp and stamp pad reduce accidental marking and preserves the quality of the ink within the stamp pad.

Articulating hand stamps are not new as demonstrated by German Patent No. 35,694 to Weylandt. A more recent hand stamp, of the articulating type, is described in U.S. Pat. No. 4,530,281 which issued July 23, 1985 to Verdenne. This type of articulating stamp has a split housing with the housing portions pivotally mounted to one another at one end. A stamp carrier bearing indicia is cammed with respect to one of the housing portions and pivotably mounted with respect to the other. The physical act of separating the housings via a pinching of one end of the stamp mechanism cams the stamp carrier to an open position. Such stamps have proved to be commercially popular.

A disadvantage of the articulating stamps is the frequent misuse by the user. In other words, due to the configuration of such stamps, there is a significant tendency by the user to strike the object to be stamped such that more pressure is exerted at one side of the pad than the other. This may cause the print of the indicia on the object to be darker toward one side.

Still another problem frequently encountered is the difficulty in initial opening the mechanism or, when made easier to open, the unintentional opening due to accidentally dropping or even the act of handling.

These and other disadvantages are successfully addressed by the stamp mechanism described below.

SUMMARY OF THE INVENTION

In accordance with the present invention, a hand stamp mechanism is provided which is capable of being articulated between open and closed positions and includes a stamp carrier and pad bearing indicia, a first housing member having a grasping portion, and a second housing member pivotably connected to the first portion. The stamp carrier is pivotably connected to one of the housing portions and in a camming relationship with the other such that the stamp carrier is cammed to an open position when the housing portions are pivoted apart. The grasping portions have surfaces which are canted and diverge from each other in a direction away from the stamp pad when the mechanism is closed. The torque created by the pinching action on the canted surfaces facilitates opening of the mechanism.

DETAILED DESCRIPTION OF EXEMPLARY EMBODIMENTS

Figure 1:
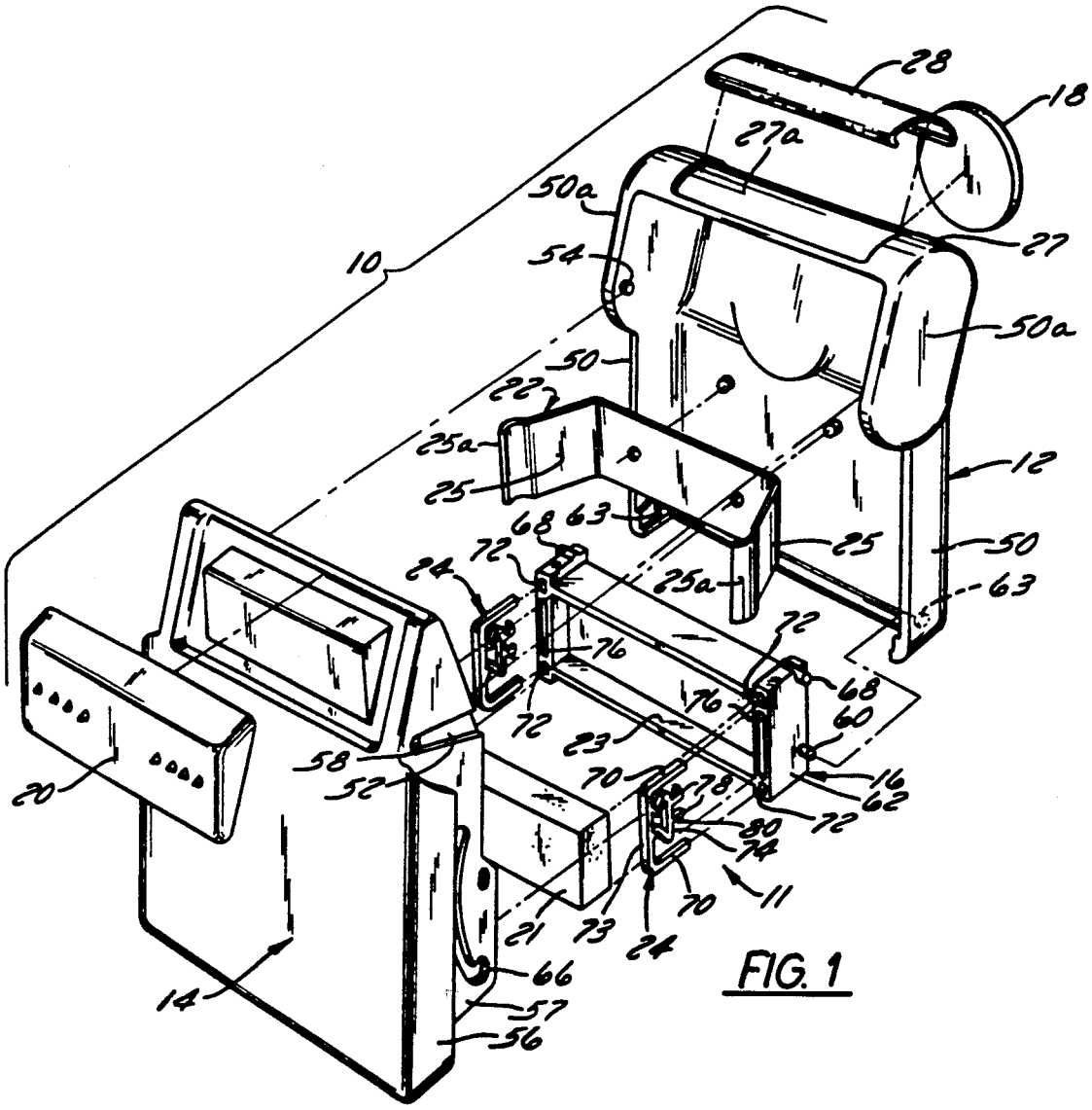
FIG. 1 is an exploded perspective of the articulating hand stamp mechanism in accordance with the present invention.
Figure 3:
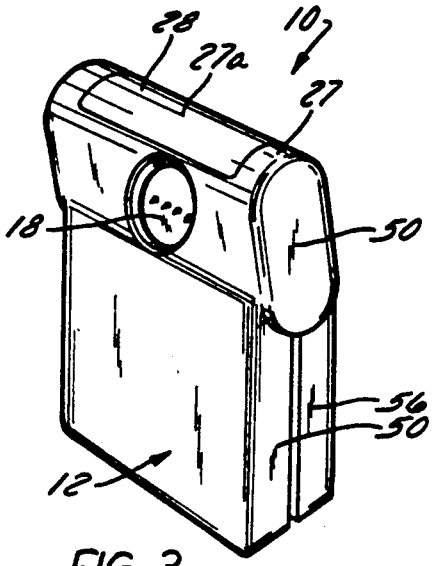
Figure 4:
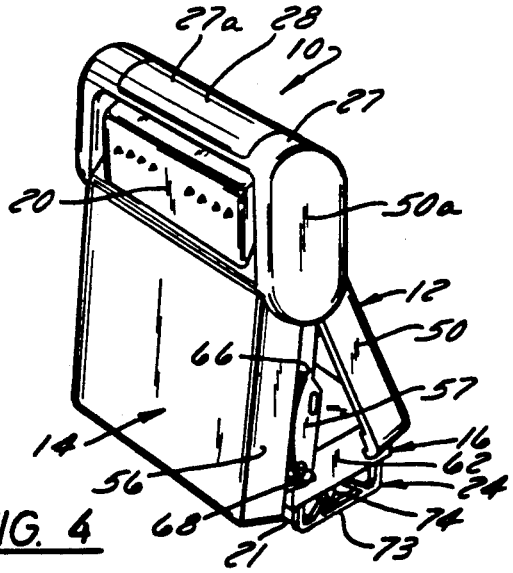
FIGS. 4 and 5 are perspective views of the hand stamp mechanism viewed from the cam housing side in the open and closed positions, respectively.
Figure 5:
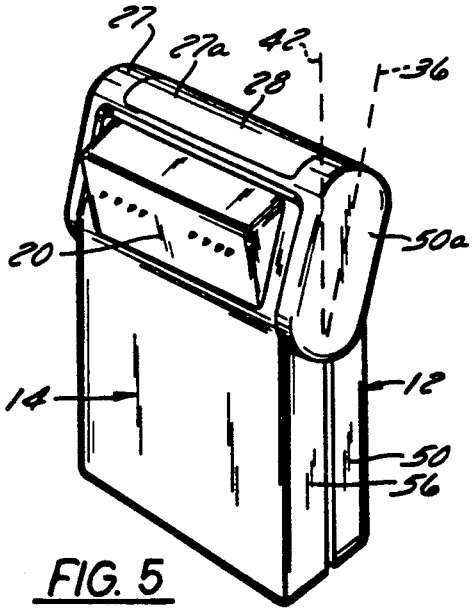

Reference is first made to the exploded perspective of FIG. 1 which depicts an articulating hand stamp mechanism in accordance with the present invention by character numeral 10. Housing 12 and cam housing 14 enclose the following major components: stamp carrier 16, a recess 23 adapted to receive stamp pad 21, a retaining spring 22, and a pair of platen springs 24. FIGS. 3 and 5 depict stamp mechanism 10 in a closed position in which each of the aforementioned components are enclosed. Housing 12 and cam housing 14, respectively, carry a thumb button 18 and finger button 20, each preferably fabricated from an elastomeric material. Optionally, housing 12 may be provided with a rounded top wall 27 having a recessed area **27*a* adapted to receive a strip of material bearing written information corresponding to and identifying the indicia carried by stamp pad 21. The written information serves as a quick identifying reference to distinguish this stamp mechanism 10 from a number of other similar hand stamps with which mechanism 10 may be stored. Recessed area 27*a* may be suitably enclosed by transparent window member 28**.

Figure 2:
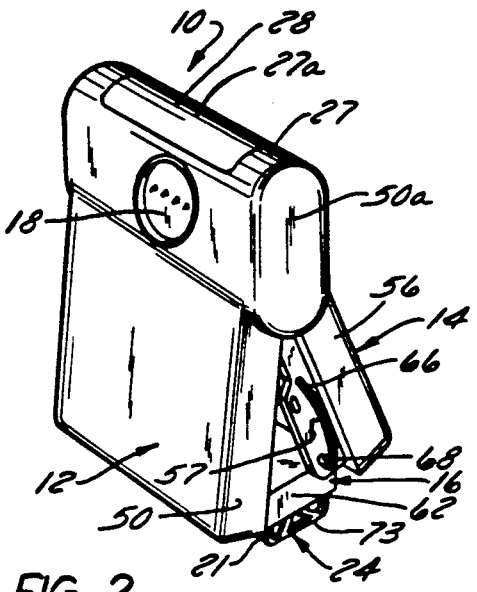
FIGS. 2 and 3 are perspective views of the hand stamp mechanism viewed from the housing side in the open and closed positions, respectively.
Figure 8:
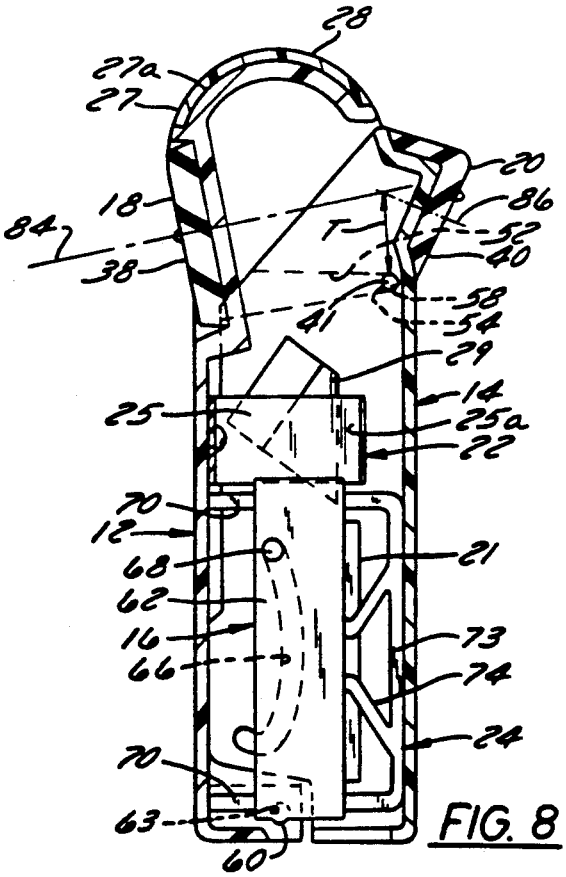
FIG. 8 is a side sectional view of the stamp mechanism when in a closed position.

As best seen in FIG. 1, housing 12 is provided with side walls 50 having a lower portion which abut side walls 56 of cam housing 14 when mechanism 11 is closed (See FIGS. 2 and 5). The upper portion **50*a* of side walls 50 have an oval configuration for purposes described below. Mounted inside of walls 56 are a pair of internal side walls 57 which project beyond walls 56 and are adapted to slide inside walls 50 as the mechanism is closed. The inside surface of internal walls 57 are provided with a pair of slots 52 adapted to receive pivot members 54 mounted on the inside surface of walls 50. Upon assembly of mechanism 10 side walls 57 slide inside of side walls 50 and members 54 move along slots 52 until members 54 snap into pivot holes 58. Thereafter, housings 12 and 14 are mounted for relative pivot motion and around the axis of pivot defined by members 54 and holes 58 as best shown in FIG. 8**.

Figure 6A:
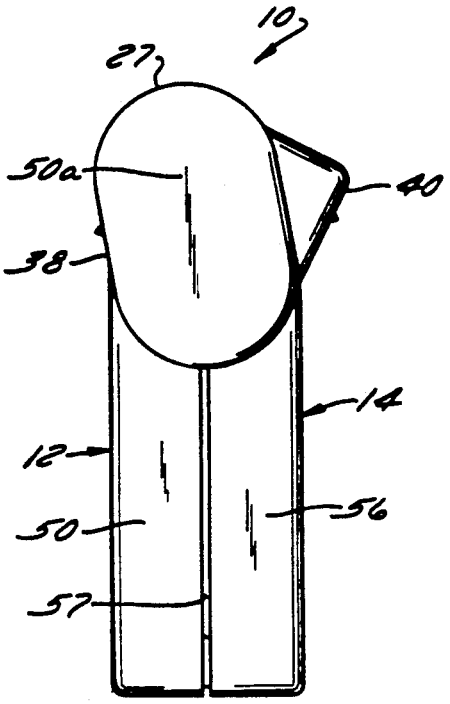
FIGS. 6A and 6B are side views of the mechanism in closed and open positions, respectively, with FIG. 6B depicting the stamp carrier and the relationship of the retaining spring and retainer partially in phantom.
Figure 6B:
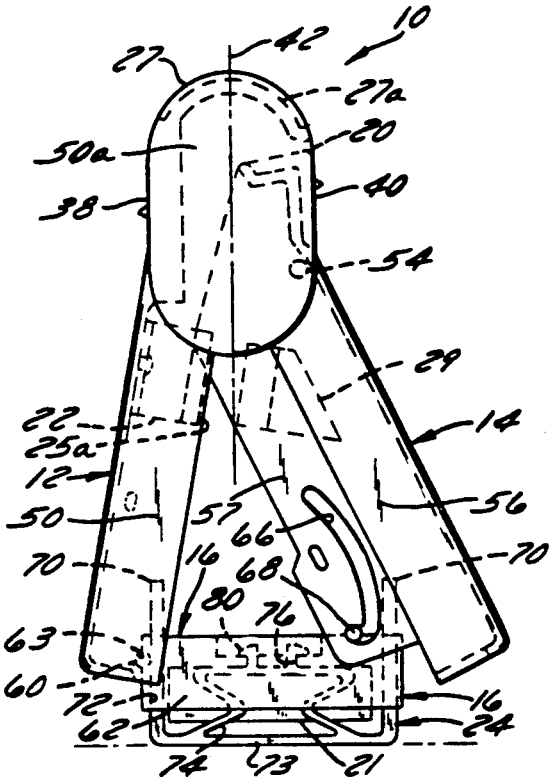

Housing 16 is mounted for pivot action relative to housing 12 by the rotation of pivot members 60 protruding from the outside surfaces of side walls 62 within complimentary slots 63 (shown in dotted lines in FIG. 1) in the inside surface of walls 50. The interaction of pivot members 60 and slots 63 is best seen in FIGS. 6B and 8. Each side wall 57 is provided with a cam slot 66 which interacts with a respective cam follower 68 mounted on the outside surfaces of side wall of housing 16. Housing 16 is shown in its operative state in FIG. 6B with stamp member essentially disposed horizontally. Housing 16 is maintained in this state by the disposition of cam follower 68 protruding from side wall 16 within the curved end of cam slot 66. Once follower 68 is dislodged from the curved end of slot 66 and begins to move along slot 66, housing 16 is forced to pivot upward into the space between sidewalls 50. Ultimately, when housings 12 and 14 are closed, housing 16 is completely enclosed as seen in FIG. 8.

Figure 7:
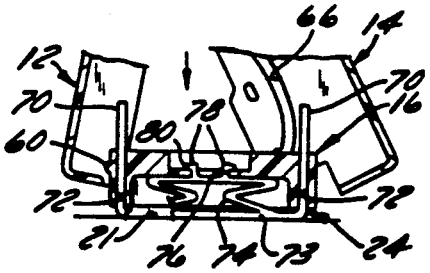
FIG. 7 is a broken away side sectional view of the stamp carrier.

Reference is again focussed upon FIG. 1 and the relationship of platen springs 24 and housing 16. Each spring 24 has a pair of legs 70 configured to fit within and penetrate completely through complimentary-shaped openings 72 in side walls 62. The interior portion of spring 24 has a bellow shaped extension 74 (as best seen in FIG. 7) ending in a pair of snap fingers 78. As spring 24 is inserted into sidewall 62, extension 74 is compressed and the heads 80 of snap fingers 78 bow inwardly along the inner walls of slot 76 and then snap outwardly once heads 80 clear the end of slots 76 and thus lock spring 24 into place. With the compression of extension 74 being relieved, extension 74 abuts the rear surface of housing 16.

As perhaps best seen in FIG. 7, the member 70*a* connecting legs 70 extends slightly beyond the facing surface of stamp pad 21 and rests against the surface of an object to be marked when no downward pressure is being entered on stamping mechanism 10. The clearance between the stamp pad 21 and the surface of the object thus permits mechanism 10 in its open state to be placed upon and moved about the surface without accidently marking it. As downward pressure is exerted, however, legs 70 are forced into slots 72 and stamp pad 21 impacts the surface of the object to be marked. Once the pressure is released, stamp pad 21 will spring back away from the surface.

Mechanism 10 is maintained in the open position due to the positioning of spring 22 against cam protrusion 29 (shown as dotted lines in FIG. 6B). Spring 22 is depicted in FIG. 1 with outwardly flared arms 25 terminating in rounded cam surfaces 25*a* illustrated in FIG. 1. As stamp mechanism 10 is closed, cam surfaces 25*a* ride over cam protrusion 29. Arms 25 are caused initially to flex inwardly and once surface 25*a* clear protrusions 29, arms 25 spring outwardly. In this, the closed state of mechanism 10, spring 22 now serves to resist accidental opening.

An extremely advantageous feature of the articulating hand stamp mechanism of the present invention provides to the user the convenience of being able easily open the mechanism and, thereafter in one motion, uniformly stamp materials without awkward or added manipulation of the mechanism. That is, by applying natural hand motion, the user can open the mechanism and stamp an article with a uniform marking. Reference is now made to FIGS. 2-5, 6A and 6B and the ensuing discussion to better appreciate this feature. In the side views of FIGS. 2-5, it may be seen that side walls 50*a* and top wall 27 of housing 12 collectively form a handle having an oval or ellipsoidal side section. As illustrated in FIG. 5, the handle is actually canted with respect to a central axis of mechanism 10 when closed. The major axis 36 (dotted lines) of the ellipsoidal figure represented by side 50*a* and the central axis 42 (dotted lines) are disposed at an angle.

The canted relationship permits the two gripping surfaces of the handle represented by surfaces 38 and 40, respectively, of supporting thumb button 18 and finger grip 20 to diverge from each other in the direction away from stamp housing 16. This divergence is best seen in FIG. 8. The pivot axis about which housings 12 and 14 pivot is substantially below and displaced from the positions on surfaces 38 and 40 at which finger pressure is applied by the user to open the mechanism. The forces applied by a user's fingers, shown by dotted lines 84 and 86, as substantially normal to surfaces 38 and 40, thus creating a substantial torque (dotted lines T) about axis 41, in contrast to other prior art articulating stamp devices where the gripping/ pressure surfaces are parallel to the central axis of the mechanism and the applied force passes near the pivot axis. The availability of increased torque, as described above, further permits the use of stronger snap lock features to resist unintentional opening. Yet, because the force to open must be supplied in a particular direction, normal forces experienced by the mechanism due to handling or dropping can open the mechanism only under most improbable occurrences.

Additionally, perhaps less evident, is that the device constructed in accordance with the present invention provides a superior geometrical relationship between vertical axis 42 and the center of stamp pad 21. It may be seen, in FIG. 6B, that the central vertical axis 42 passes near the midpoint of stamp pad 21. Thus, when a user grips surfaces 38 and 40 of stamp 10 in its open position and applies a force along the vertical axis 42, i.e., a force normal to the indicia bearing surface of pad 21, against a surface of an article to be marked, the force translates in a uniform pressure, particularly in the strategic center of the pad where indicia is more likely to be located. This uniform pressure provides a consistent and more uniform image. As was discussed above, an applied normal force against a yieldable object (such as a stamp pad) which is substantially off set from the center provides an uneven pressure distribution which becomes proportionately more skewed the greater the displacement of the center from the applied force.

In operation, the articulating hand stamp of the present invention may be simply handled. As stated before, with respect to FIGS. 6A and 6B, the canted gripping surfaces 38, 40 in the closed position facilitate the natural squeezing motion between the thumbs and fingers of a user's hands such that forces exerted thereby are approximately normal to the surfaces. The preferred elastomeric covering of each surface 38, 40 provides a secure grip. Since the directions of the supplied forces are substantially displaced from the line of pivot between housings 12 and 14, a torque is created, causing the resistance of retaining spring 24 to be overcome and mechanism 10 is articulated open.

As cam housing 14 is pivoted open, stamp pad housing 16 is caused to pivot to its operative position due to the camming interaction with housing 14. Follower 68 moves along slot 66 until it reaches the end thereof. Retaining spring 22 now serves to resist undesired accidental closing by bearing against the interior of cam housing 12.

When stamp mechanism 10 is in the open position, gripping surfaces 38, 40 are substantially parallel to each other. As can best be seen in FIG. 6B, a downward force exerted by a user in a direction normal to the exposed or indicia carrying surface of stamp pad 21 acts along center line 42 between surfaces 38 and 40. The direction of the force passes substantially through the midpoint of the flexible stamp pad 21 giving substantially uniform pressure across the surface which translates into printing which is consistent in intensity from one point to another.

These and other advantageous features will become apparent to those skilled in the art upon reading of the disclosure herein.

I claim:

1. A hand stamp mechanism capable of being articulated by a user's hand between a closed position and open position in which said stamp mechanism is adapted to stamp articles with indicia comprising:

(a) a stamp pad having a surface adapted to bear indicia;

(b) a first member having a first hand grasping portion with a first pressure surface;

(c) a second member pivotably connected to said first member and having a second hand grasping portion with a second pressure surface canted at an angle with respect to the first pressure surface such that said first pressure surface and said second pressure surface diverge in a direction substantially away from said stamp pad when said stamp pad surface is vertically positioned and said mechanism is in said closed position; and (d) a third member adapted to receive said stamp pad and pivotably connected to one of said members and having a camming connection with said other of said members such that said third member is pivoted to an operative position as said mechanism is articulated to said open position.

2. The mechanism of claim 1 in which said first and second pressure surfaces are substantially parallel when said mechanism is in the open position.

3. The mechanism of claim 1 in which said first and said second pressure surfaces are canted at angles with respect to a plane essentially bisecting said mechanism in said closed position.

4. The mechanism of claim 1 in which said first member has a first housing portion pivotably connected to said stamp which is held substantially normal to the horizontal plane when stamping an article and a second housing portion canted with respect to said first portion and bearing said first pressure surface.

5. The mechanism of claim 4 in which said second housing portion has a pair of pivot axles pivotable within a pair of pivot holes in said second member.

6. The mechanism of claim 5 in which said third member is pivotably connected to said first member.

7. A hand stamp mechanism capable of being articulated by a user's hand from a closed to open position in which said stamp mechanism is adapted to stamp a surface of articles with indicia, said hand stamp mechanism comprising:

(a) a stamp pad having a surface bearing indicia;

(b) a first member having a first finger grasping portion;

(c) a second member pivotably connected to said first member and having a second finger grasping portion, said second member having an upper portion bearing said second finger grasping portion, said upper portion being substantially enclosed by said first member when said mechanism is in the open position;

(d) a third member pivotally connected to one of said first and second members and cam connected to the other of said first and second members, said third member being enclosed by said first and second members when said mechanism is closed and being cammed by said other member to an operative position when said mechanism is articulated to an open position; and (e) said first and second gripping surfaces being at an angle with respect to each other when said mechanism is in the closed position and being substantially parallel when said mechanism is in the open position.

8. The mechanism of claim 7 in which said first member has an upper section adapted to receive and close said upper portion.

9. The mechanism of claim 8 in which said upper section and upper portion, respectively, have pivot axles and pivot openings adapted to receive said axles.

10. The mechanism of claim 9 in which said third member is pivotably connected to said first member.

11. The mechanism of claim 10 in which said first member has a means cooperating with said second member for maintaining said member in a closed position.

12. A hand stamp mechanism capable of being articulated by a user's hand from a closed position to an open position in which said stamp mechanism is capable of stamping articles comprising:

(a) a first housing having a first back wall bearing a first grasping surface on the exterior surfaces of said back wall, a pair of upper side walls connected to said back wall, a pair of lower side walls disposed internally of the plane of said upper side walls and extending from said upper side walls to a base, and a top surface connected to said upper side walls and said back wall;

(b) a second housing having a second back wall bearing a second gripping surface, a pair of side walls which abut said first member side walls when said mechanism is in a closed position, a pair of flanges internally disposed with respect to said second member side walls with at least one of said flanges bearing a camming slot, said flanges extending beyond said side walls and being completely enclosed within said first housing when said mechanism is closed, said flanges further having pivot openings for receiving pivot axles extending from interior surfaces of said first housing upper side walls, and (c) a third housing disposing a recess for receiving a stamp pad, said third housing having pivot axles adapted to fit within pivot openings formed in interior surfaces of said lower side walls of said first housing and a cam follower adapted to fit within said cam slot in one of said flanges, (d) said upper side walls of said first member each having an ellipsoidal shape with a major axis, said major axis being disposed at an angle with respect to a vertical axis of said mechanism when closed and said first back wall bearing said first gripping surface being essentially parallel to a plane formed by said major axis of said upper side walls, and said second back wall bearing said second grasping surface being substantially parallel to said first gripping mechanism when said mechanism is in the open position.

13. The mechanism of claim 12 wherein said first and second gripping surfaces diverge from each other in a direction away from said third housing.

14. The mechanism of claim 12 in which said third housing includes a stamp element adapted to print indicia on a printing surface when said mechanism is in the open position and a means for releasably biasing said element away from the printing surface until pressure is applied to said mechanism in the direction of said printing surface.

* * * * *